340-552 SR
11/15/83 OR 4,415,885

United States Patent [19] [11] 4,415,885
Mongeon [45] Nov. 15, 1983

[54] INTRUSION DETECTOR

[75] Inventor: Ronald W. Mongeon, San Jose, Calif.
[73] Assignee: Stellar Systems, Inc., San Jose, Calif.

[21] Appl. No.: 265,903
[22] Filed: May 21, 1981
[51] Int. Cl.[3] ..... G08B 13/24
[52] U.S. Cl. ..... 340/552; 340/553
[58] Field of Search ..... 340/552, 553

[56] References Cited

U.S. PATENT DOCUMENTS 3,794,992 2/1974 Gehman ..... 340/552 X
4,053,877 10/1977 Torlesse et al. ..... 340/552
4,091,367 5/1978 Harman ..... 340/552
4,135,185 1/1979 Rotman et al. ..... 340/552
4,207,560 6/1980 Poirier ..... 340/552
4,213,123 7/1980 Poirier ..... 340/552
4,224,607 9/1980 Poirier et al. ..... 340/552

*Primary Examiner*—Glen R. Swann, III
*Attorney, Agent, or Firm*—Robert G. Slick

[57] ABSTRACT

An intrusion detector is provided having transmission and receiving cables wherein the cables are leaky from an RF standpoint so that a portion of the RF energy from the transmission cable escapes and is picked up on the receiving cable. Both sine and cosine signals are detected. The cables can be buried.

7 Claims, 4 Drawing Figures

INTRUSION DETECTOR

SUMMARY OF THE INVENTION

The present invention relates to an intrusion detection system which can be completely buried underground so that there is no visual sign that a system is in place.

The system of the present invention utilizes transmission and receive cables which are made deliberately to be leaky so that some of the RF energy escapes from the transmit cable and is received on the receive cable. One easy way of accomplishing this is to provide a partially shielded coaxial cable as is later described in detail.

The detection system of the present invention operates in the VHF region from 10 to 100 MHz and preferably at about 60 MHz. The transmitter is normally crystal controlled and not modulated while the receiver employs very narrow band width filters so that there is little likelihood of the system interfering with other services or for chance electrical disturbances to trigger false alarms. The frequency of 60 MHz was selected since it is particularly sensitive to size and height of the average human being.

The receive cable receives two sources of signals of interest, one coupled from the transmit cable and a second which leaves the transmit cable, is reflected off the intruder, and then couples into the receive cable. The phase of the signal reflected back from the intruder can be of any phase depending upon his position or location with respect to the buried cables. Thus the signal reflected from the intruder must be considered random in phase and the present invention utilizes both sine and cosine detectors. Either one or both of the detectors may respond to the intruder.

The cables of the present invention are designed to be leaky, and there is some attenuation along the length of the cable both due to the leaky nature of the cable and the ohmic loss in the shield. In accordance with a preferred embodiment of the present invention, the transmitter is located at one end of the cables while the receiver is located at the other end of the cables. This means that the receiver is most sensitive at the point farthest from the transmitter so that the attenuation in the transmit cable is offset by attenuation in the opposite direction in the receive cable.

In accordance with another aspect of the present invention, provision is made for a direct current supervisory circuit so that an alarm will be sounded in the event that a cable is cut or otherwise interfered with.

In accordance with another aspect of the present invention, synchronizing means are provided so that a number of systems can be operated in phase with each other, thus preventing one system from interfering with the next.

Other objects and features of the invention will be brought out in the balance of the specification.

DESCRIPTION OF THE PREFERRED EMBODIMENTS

Figure 1:
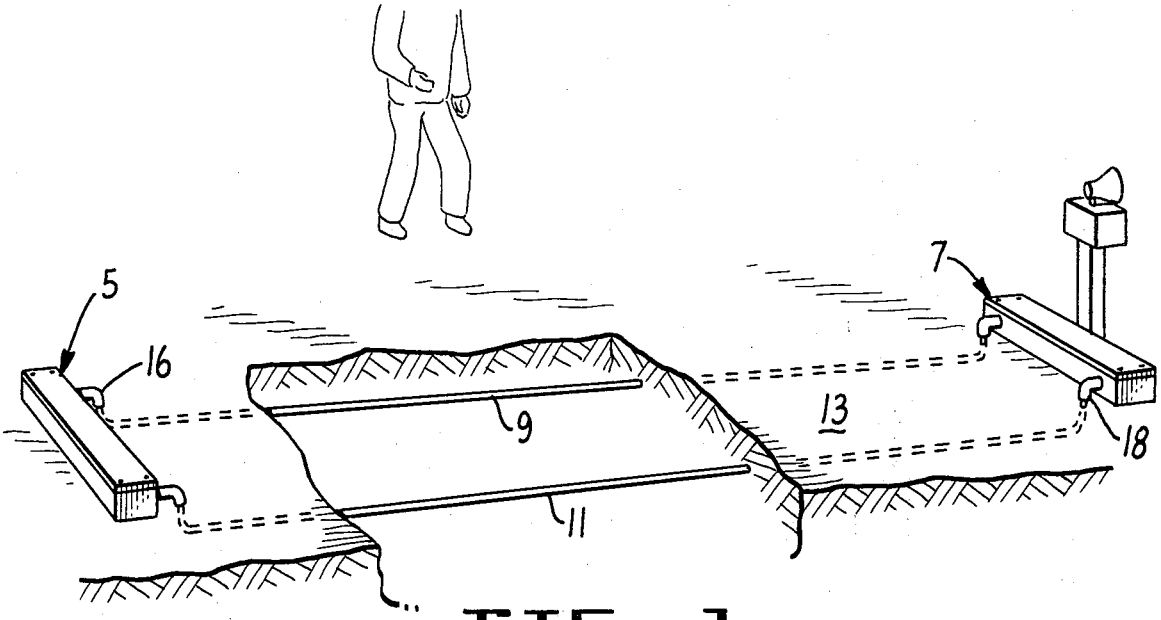
FIG. 1 is a perspective view, partly in section, of an alarm system embodying the present invention.

Referring now to the drawings by reference characters, the system of the present invention embodys a transmit unit, generally designated 5 and a receive unit generally designated 7, the two units being connected by a transmit cable 9 and a receive cable 11. In a practical embodiment of the invention, transmitter 5 operates at a frequency of 60 MHz and the cables 9 and 11 were located from 40 to 50 inches apart and about 4 to 6 inches under the surface of the soil 13. The units 5 and 7 may be several hundred feet apart. Although the cables are ordinarily buried, they may lie on the surface, as in a temporary installation.

Figure 2:
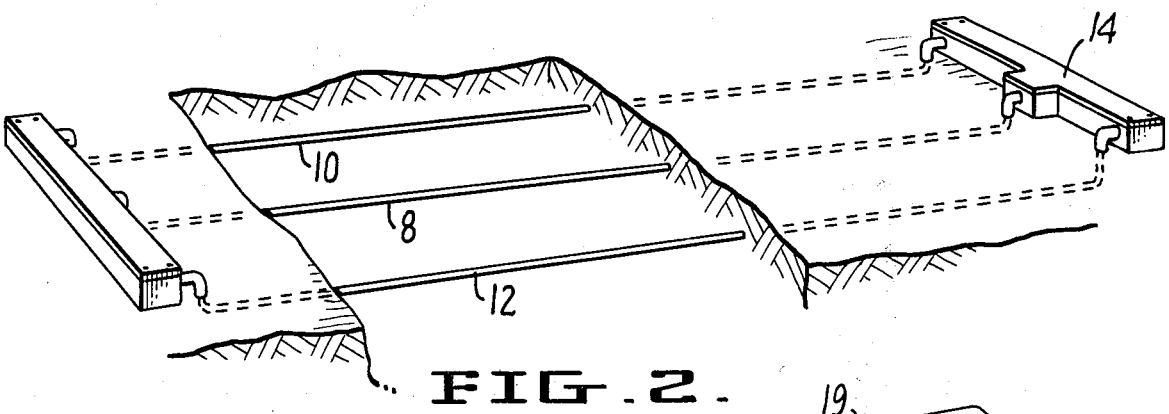
FIG. 2 is a perspective view, partly in section, showing a system with two receive cables.

The width of coverage along the buried line installation can be increased by adding a second receive cable on the opposite side of the transmit cable. Such an installation is shown in FIG. 2 wherein a single transmit cable 8 is employed together with the receive cables 10 and 12 which lie on opposite sides of the transmit cable. At the receiver 14, the received signals from both cables 10 and 12 are added together in a resistive power combiner before entering the receiver unit.

Figure 3:
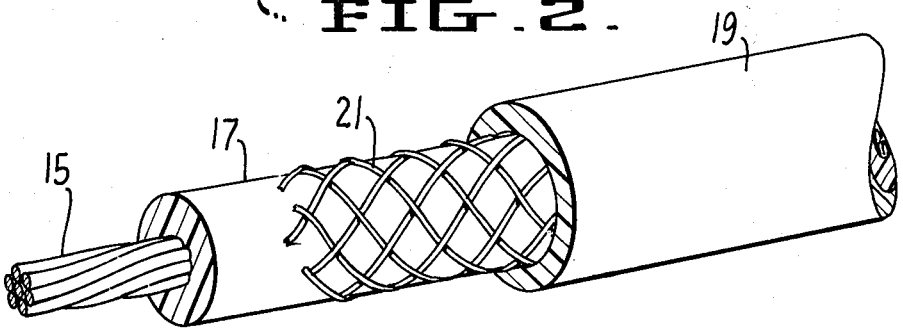
FIG. 3 is an enlarged view of a leaky coaxial cable used in the present invention.
Figure 4:
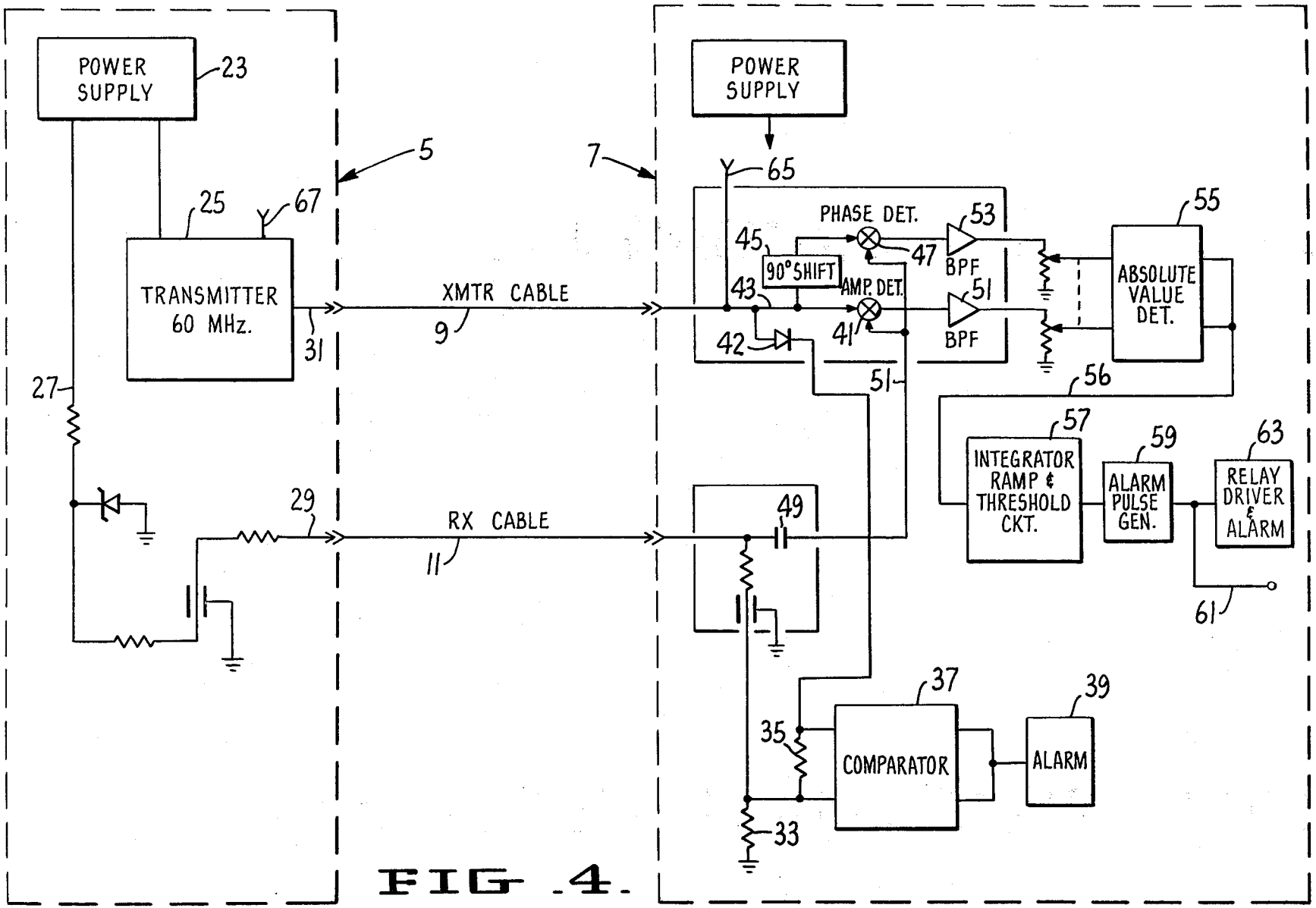
FIG. 4 is a block diagram of the electronic circuitry employed in the present invention.

In order to carry out the present invention it is necessary to provide RF conductors which have sufficient shielding to carry RF current yet not sufficient to completely confine current as is the case of a fully shielded coaxial cable. Various means can be employed to provide for a leaky cable but in one practical embodiment of the invention a leaky cable was provided merely by reducing the amount of shielding on the outer braid as is shown in FIG. 3. Here the coaxial cable has the usual inner conductor 15, insulation 17 and outer sheath 19. However, it will be seen that the outer braid or shield 21 has only a relatively few strands of wire therein so that the cable is only partly shielded. Such a coaxial cable is capable of carrying the RF energy but at the same time a desired portion of the RF energy will escape, whereupon it can be detected by a similar leaky receive coaxial cable.

The leaky coax is used only for the buried portion of the system and the receive and transmit units may be located at some distance from the actual desired detection area and connected to the detection cables by means of standard, i.e. fully shielded, coaxial cables. Thus the connections to the transmit and receive sections such as those designated 16 and 18, respectively, could actually be long lengths of standard coaxial cables rather than the short connections illustrated.

Transmitter unit 5 contains a power supply 23 of conventional design which provides two outputs, one to a transmitter, preferrably of the crystal control type 25 which puts out an unmodulated signal in the VHF region, typically at 60 MHz. Power supply 23 also has an output of direct current in line 27. This direct current circuit goes to the far end of the receive cable through line 29. It will be seen that the DC component through the receive cable develops a voltage across resistor 33. In the transmitter line 9, diode 42 detects the 60 MHz signal and develops a voltage across resistor 35. These voltages are fed into the comparator 37 and if either voltage departs substantially from a target voltage, an alarm 39 is set off as a warning that someone has tampered with the system.

The output from the transmitter cable is fed directly to the detector 41 through line 43. Line 43 also feeds a 90 degree phase shift network 45 and the output of the phase shift network is fed into the detector 47. These detectors are identical double balanced mixers, one having its local oscillator phase shifted 90° by item 45 in FIG. 3. At the same time the RF component received on cable 11 passes through the blocking capacitor 49 and is fed by line 51 into the two detectors. The output from the detectors 41 and 47 is passed through the very narrow band pass filters 51 and 53, respectively, and into the absolute value detector 55. If a perturbation is found in either the inphase detector or the quadrature detector, the absolute value detector, which can be considered as an OR gate, will develop an output voltage which will be passed to integrator and threshold circuit 57 and, if it exceeds a preset value, will set off the alarm pulse generator 59. Output can be taken directly from the alarm pulse generator through line 61 or can be further amplified through the relay driver and alarm 63.

If one attempted to operate two systems in the vicinity of each other they would interfere with each other unless they were phase locked at the same frequency. For this purpose, the receiver is provided with output line 65 so that a second system could be operated exactly in synchronism with the first. Similarly, the transmit section is provided with an input line 67 for receiving the signal from another system, maintaining the systems in synchronism.

Although an exact structure has been shown and certain frequencies have been called out, it will be understood that many variations can be made without departing from the spirit of this invention. It is necessary that the system work in the VHF region and 60 MHz was chosen as being a frequency lying between channels 2 and 3 and far removed from the sound or picture carriers. With the narrow band width of the system, there is little likelihood of false alarms. The partially shielded coaxial cable is only one method of achieving a leaky transmission line and other systems are well known to those skilled in the art. Similarly the distance which the conductors are buried and their separation is not critical but could be varied within wide limits.

I claim:

1. An intrusion alarm system comprising in combination:

a. RF generator and means for feeding an unmodulated output from said generator to a leaky transmission line, b. a leaky receiving line roughly paralleling said transmission line and leading to a receiver, c. means for feeding a DC voltage through said receiving line, d. rectifying means for developing a DC voltage from the RF on said transmission line, e. first alarm means comprising a comparator for comparing the DC voltages from (c) and (d) and sounding an alarm if the voltages differ substantially from a target value, f. second alarm means comprising:

(i) means for feeding the RF output from the receiving line to an inphase detector, (ii) means for shifting the phase of the RF output 90° and feeding the phase shifted output to a quadrature detector, (iii) feeding the output of the inphase and quadrature detectors to an absolute value detector which acts as an OR gate whereby (iv) said second alarm means actuated by a perturbation in either the inphase or quadrature detectors.

2. The alarm system of claim 1 wherein said transmission and receiving lines are buried in the earth.

3. The system of claim 2 wherein the lines are spaced from about 40 to 50 inches apart and buried about 4 to 6 inches.

4. The system of claim 2 wherein the system operates in the VHF range of about 10 to 100 MHz.

5. The system of claim 4 wherein the frequency is about 60 MHz.

6. The intrusion alarm of claim 1 wherein said R.F. generator feeds the output into one end of the transmission line and the receiver is connected at the opposite end of the receiving line whereby attenuation in the lines is offset.

7. The system of claim 1 wherein the cables consist of coaxial cables with only a partial shield.

* * * * *